United States Patent [19]

Ryokai

[11] Patent Number: 4,793,146

[45] Date of Patent: Dec. 27, 1988

[54] COLD STORAGE STRUCTURE

[75] Inventor: Kimitoshi Ryokai, Tokyo, Japan

[73] Assignees: Shimizu Construction Co., Ltd.; Fujikura Ltd., both of Tokyo, Japan

[21] Appl. No.: 70,371

[22] Filed: Jul. 7, 1987

[30] Foreign Application Priority Data

Jul. 8, 1986 [JP] Japan ..... 61-160164
Jul. 8, 1986 [JP] Japan ..... 61-104517
Dec. 17, 1986 [JP] Japan ..... 61-194238

[51] Int. Cl.[4] ..... F25D 23/12
[52] U.S. Cl. ..... 62/260; 165/45
[58] Field of Search ..... 62/260; 165/45; 126/400

[56] References Cited

U.S. PATENT DOCUMENTS 4,346,569 8/1982 Yuan ..... 62/260
4,466,256 8/1984 MacCracken ..... 62/260

*Primary Examiner*—Henry A. Bennet
*Attorney, Agent, or Firm*—Scully, Soctt, Murphy & Presser

[57] ABSTRACT

A cold storage structure including: a storage chamber for storing articles, the storage chamber including a ceiling, a pair of side walls and a bottom wall, at least both the side walls and the bottom wall being formed in the ground; a heat accumulating layer arranged in the ground to surround at least both the side walls and the bottom wall, the accumulating layer being adapted for cooling the storage chamber; and a plurality of heat pipes mounted on the ground to extend in the heat accumulating layer to a position below the bottom wall for heat exchanging with the heat accumulating layer to cool the storage chamber.

11 Claims, 7 Drawing Sheets

COLD STORAGE STRUCTURE

BACKGROUND OF THE INVENTION

The present invention relates to a cold storage structure including a storage space for storing articles, the storage space being adapted to be cooled with a frozen material surrounding it.

It is known that cylindrical heat pipes are vertically erected on the ground to surround a cold storage chamber, formed in the ground, with underground portions thereof for producing frozen soil portions in the ground around the storage chamber to cool the latter. The heat pipe is a device in which heat is transferred according to phase change of an operating medium, contained in it, between the gaseous phase and the liquid phase. The frozen soil is produced with the cold atmosphere in the winter.

This cold storage structure is disadvantageous in that a condensed working medium which is condensed at the upper portion of the sealed cylindrical casing of each heat pipe rapidly drops to the bottom of the casing, so that evaporation of the condensed medium occurs mainly at the bottom portion thereof. Thus, endothermic action of heat pipes is limited to their bottom portions, and hence it is hard to produce a frozen soil layer having a large vertical thickness, which is capable of uniformly cooling a cold storage chamber having a relatively large height.

Accordingly, it is an object of the present invention to provide a cold storage structure which is capable of producing a frozen material having a relatively large thickness around the storage space for uniformly cooling the latter.

SUMMARY OF THE INVENTION

With this and other object in view, the present invention provides a cold storage structure comprising: storage means for storing articles, the storage means including a ceiling, a pair of side walls and a bottom wall, at least both the side walls and the bottom wall being formed in the ground; heat accumulating means arranged in the ground to surround at least both the side walls and the bottom wall, the accumulating means being adapted for cooling the storage means; and a plurality of heat pipes mounted on the ground to extend in the heat accumulating means to a position below the bottom wall for heat exchanging with the heat accumulating means to cool the storage means.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
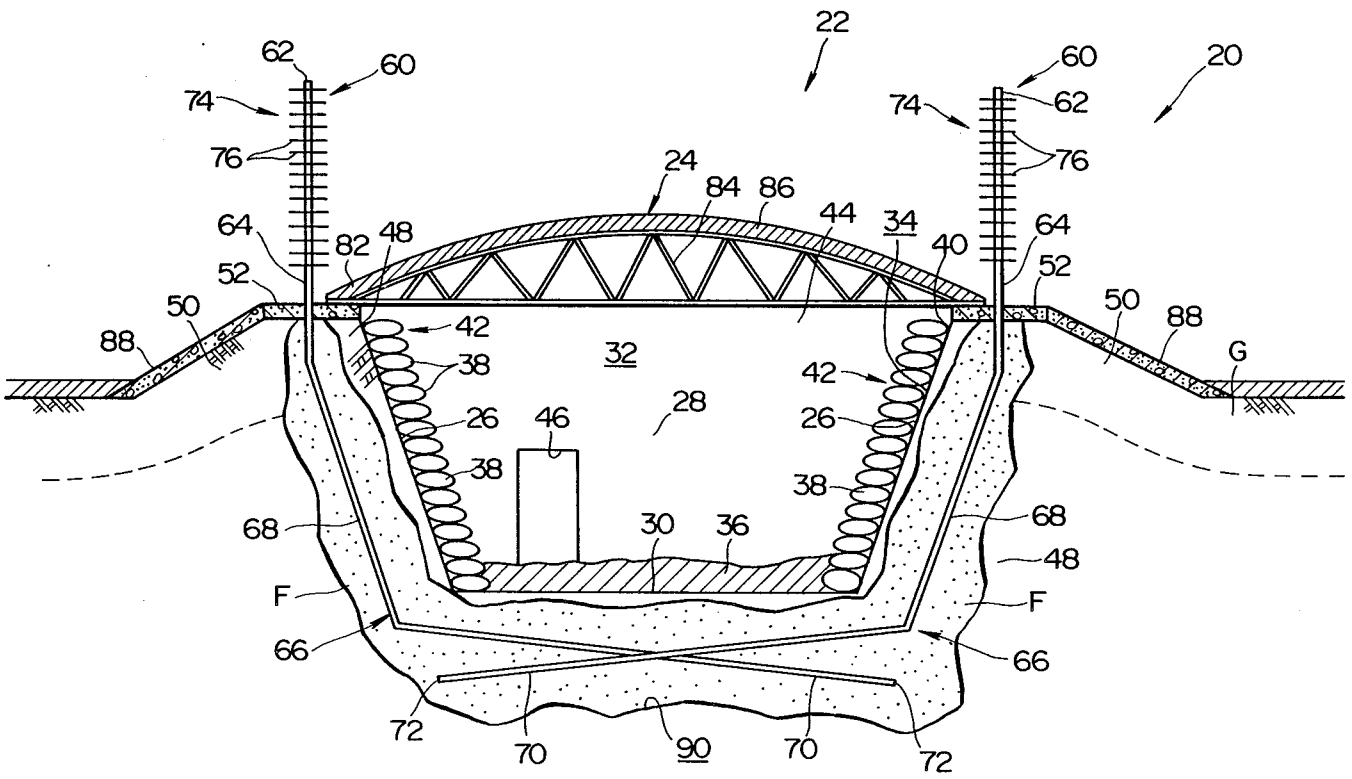
FIG. 1 is an enlarged cross-sectional view of one of cold storage structures, shown in FIG. 2, according to the present invention.
Figure 2:
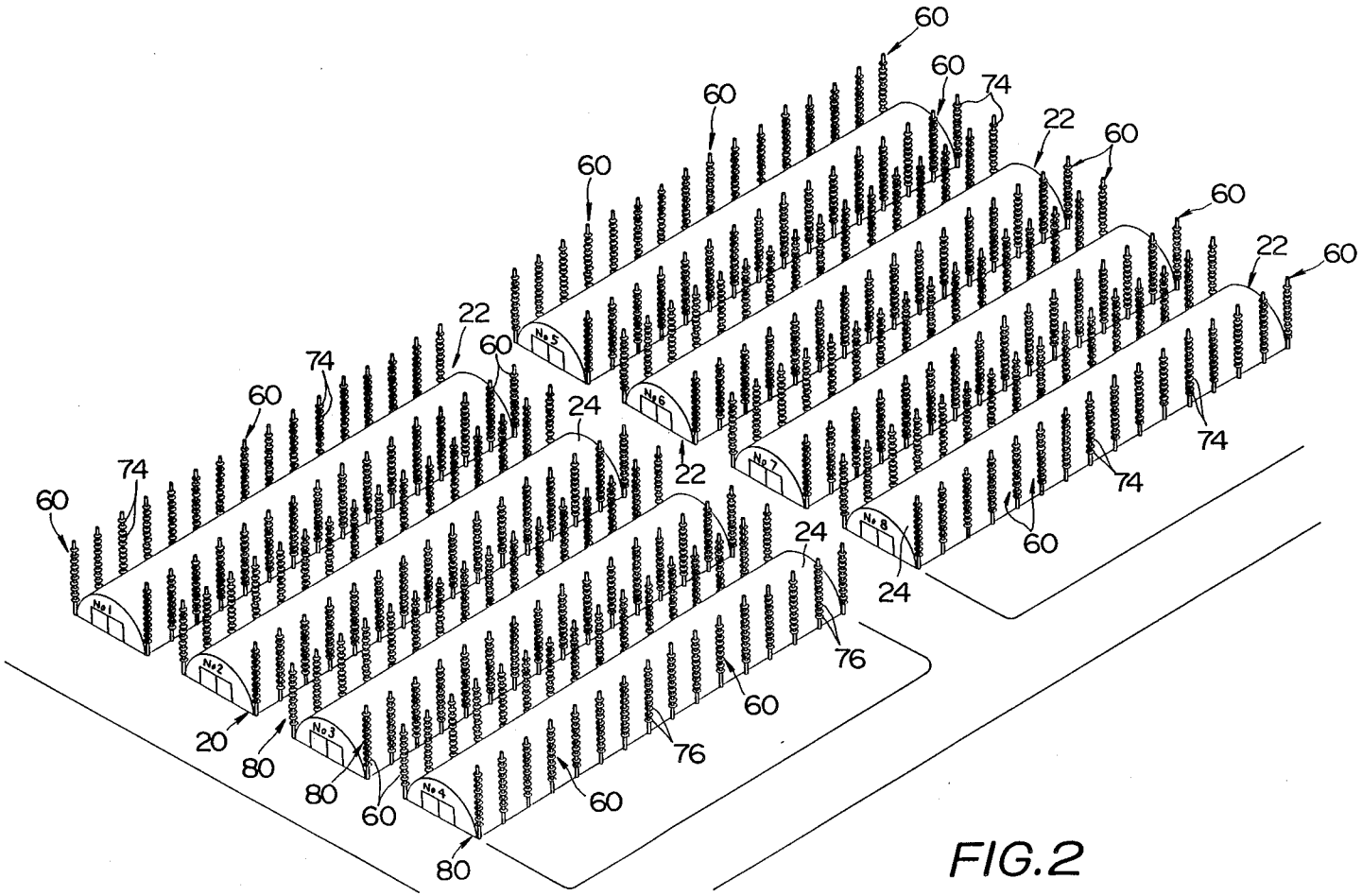
FIG. 2 is a perspective view of a group of the cold storage structures in columns and rows.

Referring now to the drawings wherein like reference characters designate corresponding parts throughout views. In FIGS. 1 and 2, each cold storage structure 20 according to the present invention includes a storage chamber 22 having a roof 24, a pair of inclined side walls 26 converging downwards, opposite end walls 28, only one of which is illustrated in FIG. 1, and a horizontal bottom wall 30. These members define a storing space 32 for storing articles such as food.

For constructing each storage chamber 22, a trench 34 is excavated in the ground G having a freezable soil, the trench 34 having a generally trapezoidal cross-section with its longer side up. The storage chamber 22 has a floor 36 formed over the bottom wall 30, the floor 36 being made of a revelling concrete but may be made of crushed stones or like materials. A large number of gabions 38 are stacked from the bottom wall 30 to the opening 40 of the trench 34 to form a gabion layer 42 for covering each inclined side wall 26. Although not shown, the other end wall is also covered with a similar gabion layer. The one end wall is covered with a concrete layer 44 and is provided with a door opening 46 which communicates to the outside for transporting articles, such as food, to and from the outside. The trench 34 is surrounded at its opposite side walls 26 and 26, the other end wall and the bottom wall 30 with a freezable soil layer 48. The freezable soil layer is preferably a cohesive soil, such as clay, which is higher in moisture content than sandy soils. The trench 34 is provided at its opening periphery with a bank 50 in the shape of a rectangular loop. The bank 50 is covered at its top with a concrete foundation 52 for supporting a roof 24.

A row of heat pipes 60 are mounted at equal intervals on the ground G along each of the side walls 26 for freezing the freezable soil layer 48. Each heat pipe 60 has a sealed cylindrical pipe 62 made of copper, stainless steel, aluminium, etc. Each sealed cylindrical pipe 62 contains an operating liquid, such as freon and ammonia, in it. Each of the heat pipes 60 in this embodiment is distinct from the conventional heat pipe in that the stem portion 64 thereof is continuous to an underground portion 66 thereof which includes a downward extending portion 68 which extends downwards in the freezable soil layer 48 in parallel with the corresponding inclined side wall 26 to a level below but near the bottom wall 30. At this level, the downward extending portion 68 laterally bends to form a laterally extending portion 70 which extends below the bottom wall 30 to a position just below the opposite inclined side wall 26. Each laterally extending portion 70 is inclined downwards to its lower end 72. Opposite heat pipes 60 and 60 in adjacent rows 80 and 80 are spaced at their laterally extending portions 70 and 70 for preventing interference but the laterally extending portions 70 and 70 may be overlapped to some lateral length. The stem portion 64 of each heat pipe 60 passes through the concrete foundation 52 and its head portion 74 has a plurality of heat receiving and radiating fins 76 for enhancing efficiency in heat transportation.

The roof 24 of each storage chamber 22 is supported at its peripheral portion 82 on the concrete foundation 52 and has a roof structure including a plurality of truss girders 84 and a heat insulating roof plate 86 covering the truss girders 84. The roof 24 is not limited to this structure but may have other conventional structures. The reference numeral 88 designates a heat insulating layer covering the bank 50. This heat insulating layer 88 is provided when temperature in the atmosphere is relatively high in summer or other seasons.

For constructing the cold storage chamber 34, a trench 34 is excavated in the ground G. Grooves 90 are formed in the trench traversing the trench 34 for receiving underground portions 66 of heat pipes 60 and after placing each heat pipe 60 in position, it is buried as illustrated in FIG. 1. Then, gabions 38 are stacked to form gabion layers 42 for covering opposite side walls 26 and 26 and the other end of the trench 34, after which levelling concrete 36 is placed over the bottom wall 30 of the trench 34 to form a concrete floor 36. After forming a concrete foundation 52, a roof 24 is constructed on it.

For using the storage chamber 22 as a cold storage chamber, a frozen soil layer F, covering the opposite side walls 26 and 26 and the bottom wall 30, is formed in the freezable soil layer 48 in winter; the heads 74 of the heat pipes 60 are cooled with the cold atmosphere, so that the working medium is condensed into liquid, which is evaporated as it descends along the inner walls of the underground portions 66 of the heat pipes 60 by gravity. Thus, the ground G near the underground portions 66 of the heat pipes 60 is frozen to form a frozen soil layer F which contains a low amount of heat energy. In hot or warm seasons, the storage space 32 is kept at a low temperature suitable for storing articles by heat exchanging with the frozen soil layer F.

In place of the storage chamber 22, a corrugated pipe, box culvert or a similar member having such a large diameter to provide a sufficient storage space, may be used, in which case such members are embedded or buried in the ground G.

Figure 3:
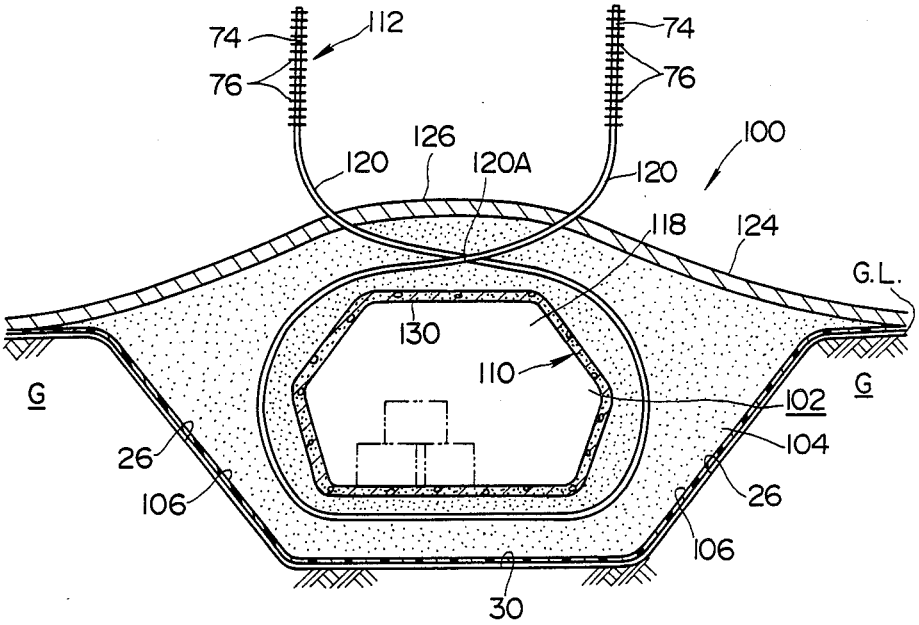
FIG. 3 is a cross-sectional view of another embodiment of the present invention.
Figure 4:
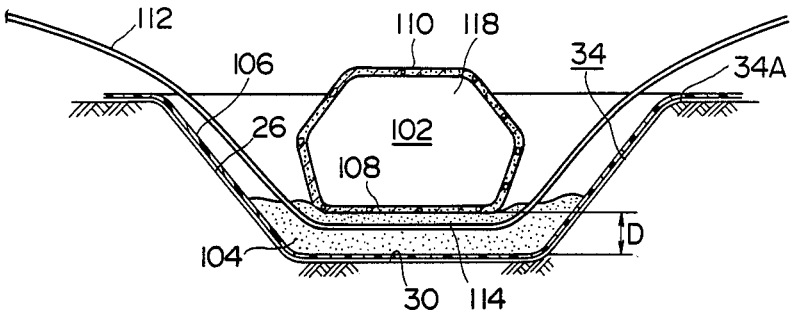
FIG. 4 is a cross-sectional view, in a reduced scale, of the cold storage structure, in FIG. 3, under construction.
Figure 5:
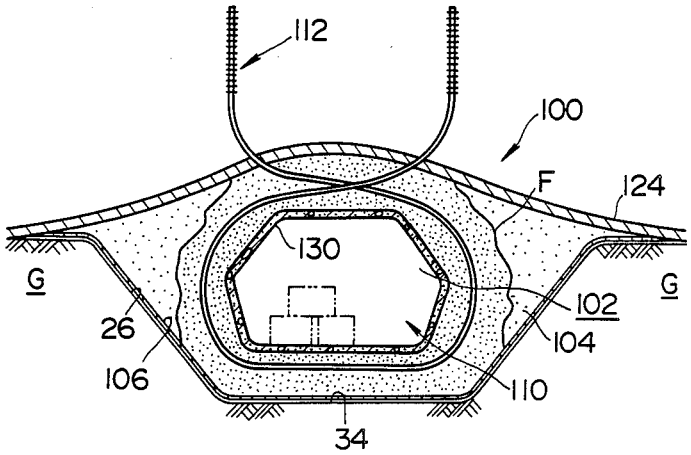
FIG. 5 is a cross-sectional view of the completed cold storage structure in FIG. 4.

FIGS. 3 to 5 illustrate another embodiment of the present invention, which cold storage structure 100 is generally distinct from the cold storage structure 20 in FIG. 1 in that the storage space 102 is surrounded with a water containing soil 104 with a high water retentivity. The water containing soil 104 may contain a water into which is dissolved a substance, which provides a high freezing-point depression, such as sodium chloride. For constructing the cold storage structure 100, a water-barrier sheet 106, such as made of a conventional synthetic resin, is placed over the front and rear end walls (not shown), opposite side walls 26 and 26 and a bottom wall 30 for covering the whole faces thereof. The water-barrier sheet 106 further covers the periphery 34A of the trench 34. The trench 34 with the sheet 106 is refilled with water containing soil 104 substantially to a half of the distance D between the bottom wall 30 thereof and the level at which the bottom 108 of a prefabricated water-barrier storage chamber 110 is to be placed. Then, each of heat pipes 112 is placed at position with its center portion 114 positioned on the refilled water containing soil 104, after which the trench 34 is further refilled with water containing soil 104 to about a third of its depth (FIG. 4). Thereafter, a prefabricated storage chamber 110 is placed on the water containing soil 104 as illustrated in FIG. 4. The water containing soil 104 below the storage chamber 110 preferably be a soil which exhibits a small frost heave action when it is frozen. With such a soil, adverse effect to the storage chamber 110 is reduced as small as possible when it is frozen. The storage chamber 110 is constructed with a concrete pipe, liner plates or like members for forming the storage space 102 having a substantially hexagonal cross-section as shown in FIG. 3 and prevents water from entering the storage space 102. The rear end 118 of the storage chamber is closed and the front end (not shown) thereof is communicated to an opening not shown to the outside. Each of the heat pipes 112 is bent around the storage chamber 110 thus placed in position with its opposite free end portions 120 and 120 crossed each other, thus forming overlapped portions 120A. The trench 34 is further refilled with the water containing soil 104 for completely covering both the storage chamber 110 and the overlapped portions 120A of the heat pipes 112. The heat pipes 112 are arranged at equal intervals in a row as in FIG. 2 longitudinally of each storage chamber 110 with their opposite heads 74 in two rows. A heat insulation layer 124 may be formed to cover the water containing soil 104, thus refilled, in a hot season. The top 126 of the cold storage structure 100 is somewhat higher than the ground level G.L. in view of the cost of forming the trench 34. When the trench 34 is formed to a relatively large depth, the top of the cold storage structure 100 may be flush with the ground surface G.L.

In the second embodiment, the roof portion 130 of the storage chamber 110 may be surrounded with a frozen soil F, as illustrated in FIG. 5, which may keep the storage space 102 at 0° C. or lower with a uniform temperature distribution. This facilitates temperature control of the storage chamber 110. A row of heat pipes 112 produce the frozen soil F surrounding the storage chamber 110 and hence reduce equipment cost.

Figure 6:
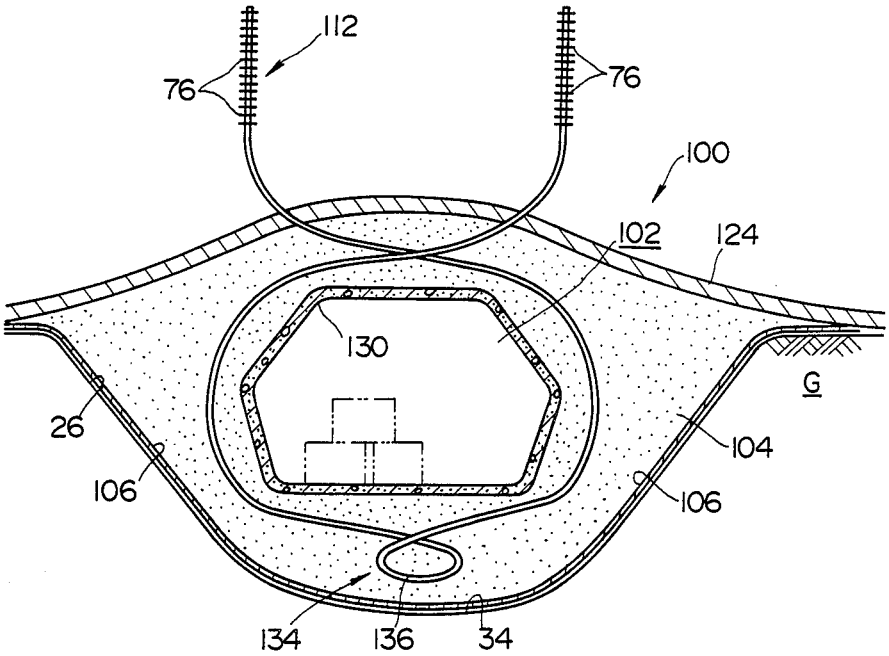
FIG. 6 is a cross-section of a modified form of the cold storage structure in FIG. 3.

A modified form of the cold storage structure 110 in FIG. 3 is illustrated in FIG. 6 in which the lowermost portion 134 of each heat pipe 112 is looped to form a sump 136 of the condensed working liquid. These sumps 136 fairly prevent deterioration in cooling capacity of the heat pipes 112 due to the condensed working medium.

Figure 7:
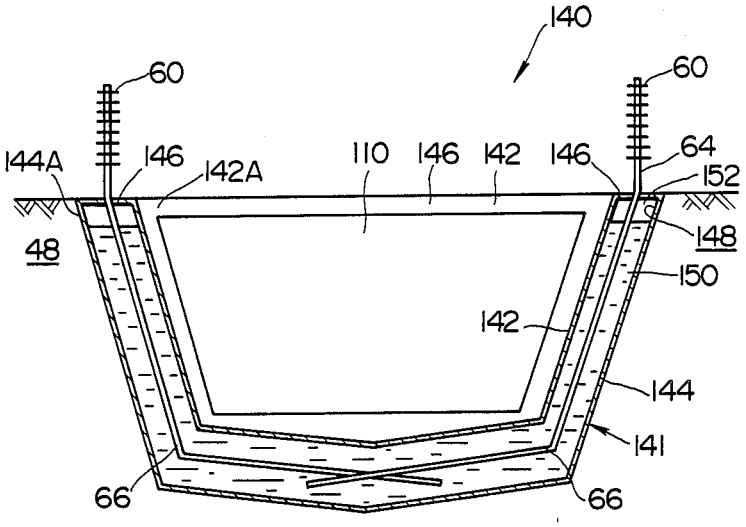
FIG. 7 is a cross-section of another embodiment of the present invention.

Still another embodiment is illustrated in FIG. 7 in which the storage chamber 110 is received in a bowl-shaped coolant reservoir 141 which is buried in the ground G. The coolant reservoir 141 has a double wall structure including an inner bowl-shaped wall 142, an outer bowl-shaped wall 144 receiving the inner wall 142, and an annular edge portion 146 connecting the upper peripheral edges 142A and 144A of the inner and outer walls 142 and 144 together to form a coolant receiving space 148. For reinforcing the coolant reservoir 141, conventional reinforcing members such as stiffeners are used although not shown. The coolant reservoir 141 contains a coolant 150 such as water. The coolant may include an additive, such as NaCl, CaCl, polyethylene glycol, $Na_2SO_4$, etc, for lowering the freezing point. Steel-wool, steel-fiber, steel meshes, steel reinforcements may be added in the coolant 150 as nucleus materials for freezing it. The heat pipes 60 pass at equal intervals through the annular edge portion 146 of the coolant reservoir 141 and the underground portions 66 extend in it.

With such a construction, the cold storage structure 140 of the third embodiment enhances performance in cooling capacity since heat conductive resistance of the coolant 150 is relatively small and heat reserving capacity is enhanced.

As an air layer 152 is formed at the upper portion of the coolant space 148 for preventing damages due to expansion of the volume of the coolant 150 when the latter is frozen, the inner and outer walls 142 and 144 of the reservoir 141 may be corrugated plates for this purpose.

A conventional heat insulating layer is preferably provided between the outer faces of the outer wall 144 of the coolant reservoir 141 and the soil 48 surrounding the coolant reservoir 141 for enhancing cooling capacity of the cold storage structure 140.

The coolant reservoir 141 may be in the shape of a tube, curved as shown in FIG. 7, of which opposite ends are closed. In this case, a large number of such curved tubes are arranged in a row longitudinally of the storage chamber 110.

Figure 8:
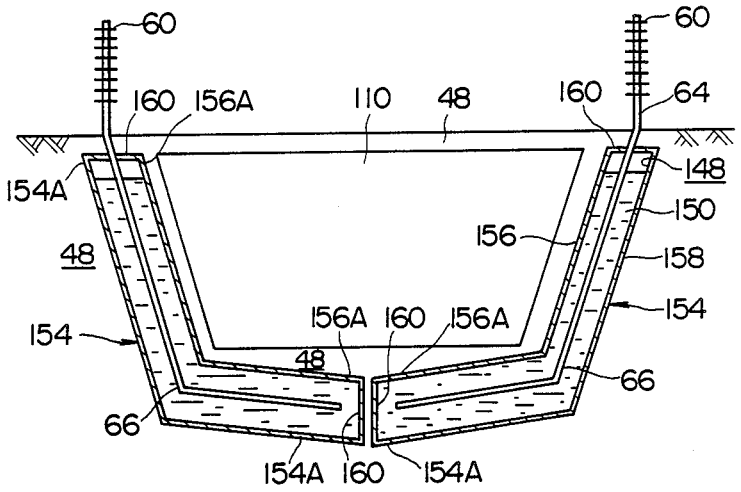
FIG. 8 is a cross-section of a modified form of the cold storage structure in FIG. 7.

The coolant reservoir 141 may be vertically divided in two halves 154 and 154 as shown in FIG. 8. Each of the halves 154 and 154 also has a double wall structure, that is, an inner wall 156, an outer wall 158 covering the outer face of the inner wall 156, and connecting edge portions 160 for closing the open edges 156A and 158A of the inner and outer walls 156 and 158 to form an coolant receiving space 148. Heat pipes 60 extend in corresponding coolant reservoir halves 154. The reservoir halves 154 facilitate fabrication.

Figure 9:
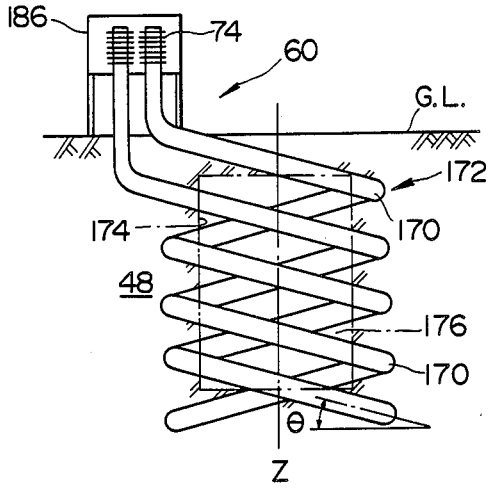
FIG. 9 is a vertical section of a modified cold storage structure in which the storage chamber is illustrated by a dot-and-dash line for illustration purpose.
Figure 10:
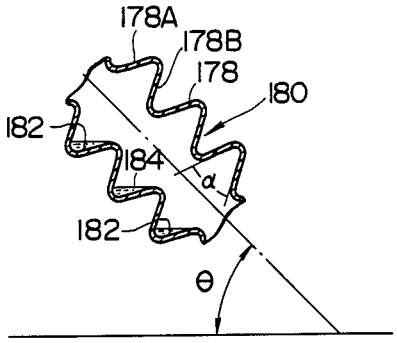
FIG. 10 is an enlarged vertical, axial section of the corrugated portion of one heat pipe in FIG. 9.
Figure 11:
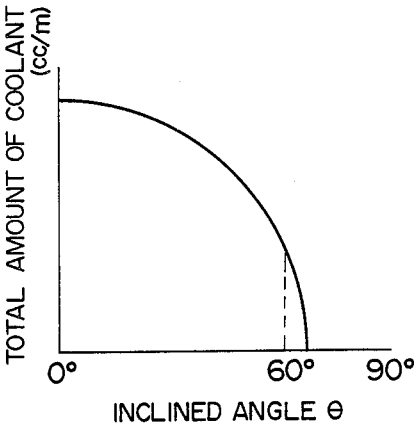
FIG. 11 is a graph showing the relationship between the total amount of the coolant in the corrugated portion of one heat pipe per unit length and the inclined angle $\theta$ to the horizontal plane.

FIG. 9 illustrates a modified form of the heat pipes 60 in FIGS. 1 and 7, which modification uses a corrugated pipe 170 for the underground portion 172 of each heat pipe 60. A pair of heat pipes 60 surround the circumferential walls 174 of a hollow cylindrical storage chamber 176 at their underground portions 172 in double helix about a vertical center axis Z of the storage chamber 176. The inclined angle $\theta$ to the horizontal plane is preferably limited within a range in which each projected portion 178 of the corrugated portion 180 of each of heat pipes 60 serves as a sump 182 as illustrated in FIG. 10. The inclined angle $\theta$ is preferably 5° to 60° although it also depends upon angle $\alpha$ which is formed by upper and lower walls 178A and 178B of each projected portion 178. This angular range is based on the graph, in FIG. 11, illustrating the relationship between the total amount of the coolant 184, retained in the projected portions 178 of a unit length of one corrugated portion 180, and the inclined angle $\theta$. In this modification, the head portions 74 of the heat pipes 60 are placed in a shed 186, having good ventilation, for sheltering from rain and snow and for facilitating maintenance. The heat pipes 60 are fairly large in strength and flexibility at their corrugated portions 180 and are less liable to damages due to ground subsidence than the heat pipes of the preceding embodiments. These modified heat pipes 60 perform endothermic functions over their whole corrugated portions 180 since the projected portions 180 serve as a sump 182. Thus, the heat pipes 60 provide fairly larger endothermic area than the heat pipes in preceding embodiments, so that they provide more uniform cooling to the storage chamber 176. Further, the limitation that the height of the storage chamber depends on the performance of heat pipes 60 is improved. In the modified heat pipes 60, it is not necessary to provide any wick since the projected portions 178 which serve as sumps keep coolant 184 at a substantially even amount over their overall length, thus reducing cost.

Figure 12:
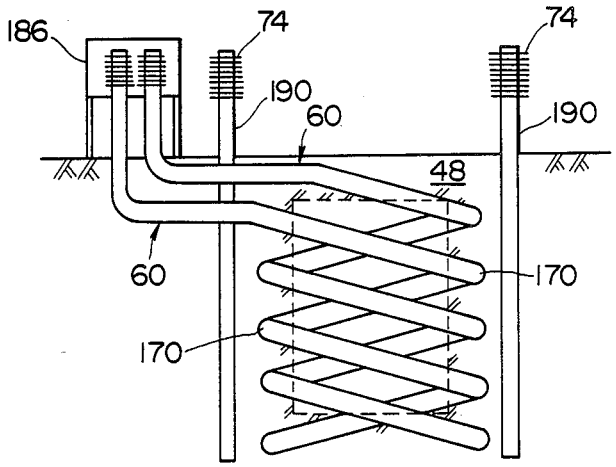
FIG. 12 is a vertical section of a modified form of the cold storage structure in FIG. 9.

A further modification form of the heat pipes 60 in FIG. 9 is illustrated in FIG. 12, in which additional vertical heat pipes 190 are mounted adjacent to the spiral portion 170 of the heat pipes 60 to form a network of the heat pipes which freeze the soil 48 more uniformly than the heat pipes 60 in FIG. 9. Preferably, the heat pipes 190 have the same corrugated structure as the heat pipes 60 in FIG. 10.

Although it is preferable that accumulated cold temperature is about 400° C. day or more, used in combination with the conventional refrigerating machine, the cold storage structure according to the present invention may be placed into practice in areas where it is relatively warm in winter.

What is claimed is:

1. A cold storage structure comprising:

storage means for storing articles, the storage means including a ceiling, a pair of side walls and a bottom wall, at least both the side walls and the bottom wall being formed in the ground;

heat accumulating means arranged in the ground to surround at least both the side walls and the bottom wall, the accumulating means being adapted for cooling the storage means; and a plurality of heat pipes mounted on the ground to extend in the heat accumulating means to a position below the bottom wall and shaped to surround at least both side walls and the bottom wall for heat exchanging with the heat accumulating means to cool the storage means.

2. A cold storage structure as recited in claim 1, wherein the storage means comprises recessed walls, formed in the ground, having an opening above said walls and a roof supported on the recessed walls for covering said opening, the recessed walls including the side walls and the bottom wall; the heat accumulating means includes a freezable soil layer surrounding the recessed walls and the bottom wall; and each of said heat pipes having a bottom portion extending substantially laterally in the freezable soil layer below the bottom wall for freezing the soil layer to a position below the bottom wall.

3. A cold storage structure as recited in claim 2, wherein the cold storage structure is provided in a plurality, and wherein the cold storage structures are arranged in the ground in columns and rows in close proximity to each other.

4. A cold storage structure as recited in claim 1, wherein the heat accumulating means is a freezable soil; the storage means is a storage chamber buried in the freezable soil; and the freezable soil is isolated from the ground by a water barrier layer for keeping moisture from escaping said freezable soil.

5. A cold storage structure as recited in claim 4, wherein each of the heat pipes includes opposite end portions and comprises a pair of head portions formed at each of said opposite end portions, said heat pipes perimetrically surrounding the side walls and bottom wall of the storage chamber with said head portions exposed to the atmosphere.

6. A cold storage structure as recited in claim 1, wherein the heat accumulating means is a reservoir having a double wall structure for containing a coolant therein, the reservoir receiving the storage means therein; and the heat pipes are arranged to extend in the coolant.

7. A cold storage structure as recited in claim 1, wherein each of the heat pipes includes a spiral portion laterally surrounding the perimeter of the side walls of said storage means.

8. A cold storage structure as recited in claim 7, wherein each spiral portion includes a corrugated portion for defining sumps to accumulate an operating medium, whereby each spiral portion is inclined at an angle to the horizontal to allow said operating medium to accumulate and be retained in said sumps.

9. A cold storage structure as recited in claim 8, wherein the corrugated portion is constructed to have axial flexibility to prevent damage due to ground subsidence.

10. A cold storage structure as recited in claim 5, wherein the storage chamber includes a roof portion; each heat pipe further surrounds the roof portion and has crossed portions crossing each other above the roof portion and in the freezable soil.

11. A cold storage structure as recited in claim 10, wherein each heat pipe includes a looped portion located below the bottom wall.

* * * * *